United States Patent [19]

Dufey

[11] 4,302,967

[45] Dec. 1, 1981

[54] APPARATUS FOR MEASURING THE MECHANICAL CHARACTERISTICS OF A BODY

[76] Inventor: Victor A. Dufey, Chaussée de Namur 74, B-5800 Gembloux, Belgium

[21] Appl. No.: 153,658

[22] Filed: May 27, 1980

[30] Foreign Application Priority Data

May 30, 1979 [BE] Belgium ..... 195472

[51] Int. Cl.[3] ..... G01N 3/00

[52] U.S. Cl. ..... 73/84; 73/843

[58] Field of Search ..... 73/84, 794, 843, 821, 73/847

[56] References Cited

U.S. PATENT DOCUMENTS 3,712,121 1/1973 Fletcher et al. ..... 73/84

3,797,301 3/1974 Hawes ..... 73/84

*Primary Examiner*—Jerry W. Myracle

*Attorney, Agent, or Firm*—Blanchard, Flynn, Thiel, Boutell & Tanis

[57] ABSTRACT

The apparatus comprises two coaxial elements (1,2), a first element (4) provided between the said two elements (1,2) and arranged to combine them and to oppose the relative displacements of the elements along their common axis (3), when a stress along the axis is applied at the free end of one of these elements and directed towards the other element, and also to oppose the relative rotation of the elements, a probe (7) affixed to the free end (6) of one of the elements (2), a second element (8) provided at the free end (5) of the other element (1) to apply the aforementioned stress and a torque to the elements (1,2), a cursor (9) arranged to move along the element (2) bearing the probe (7), parallel to the axis (3), from the free end (10) of the probe (7) towards the other element (1), when the probe penetrates into the body or medium to be measured and a third element (11) arranged, in a first position, to enable the aforementioned stress along the axis (3) and the displacement of the cursor (7) on the element (2) to be measured simultaneously and, in a second position, for the simultaneous measurement of the stress along the axis and the aforementioned torque, the conversion from the first position to the second position being obtained by a locking appliance.

15 Claims, 16 Drawing Figures

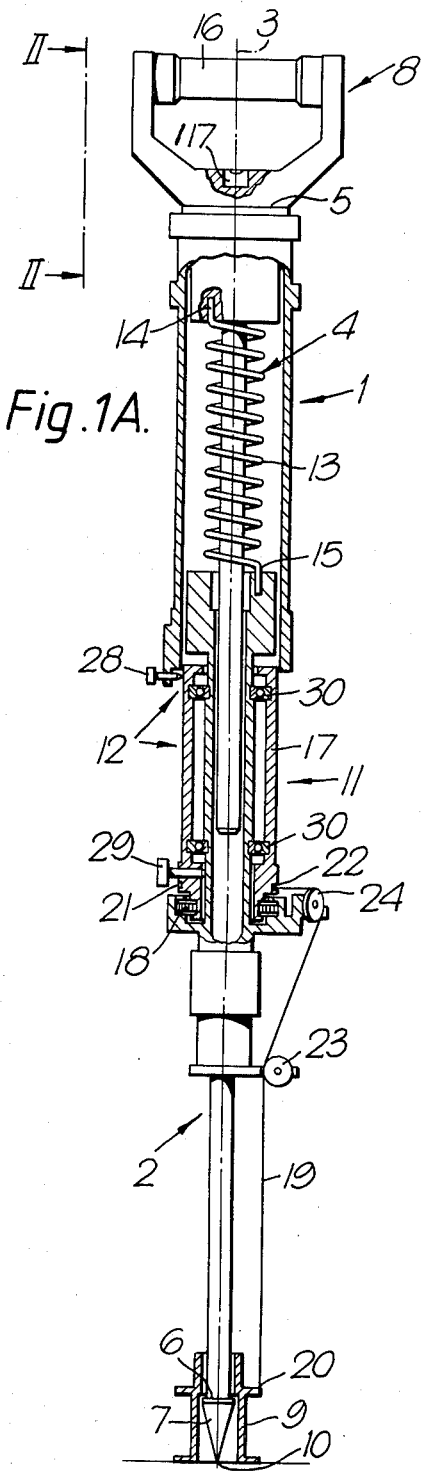
Fig. 1A.
Fig. 2.
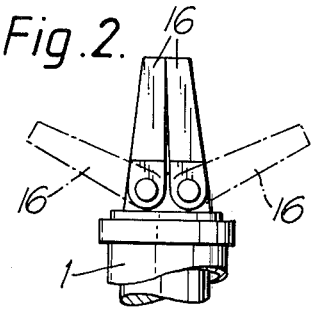
Fig. 3.
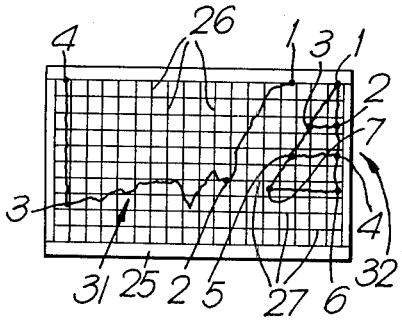
Fig. 4.
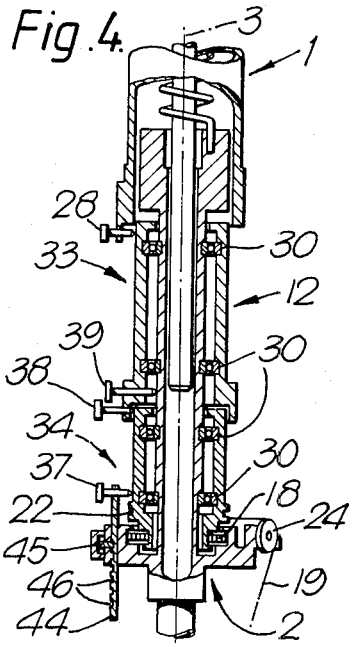

Fig. 1B.
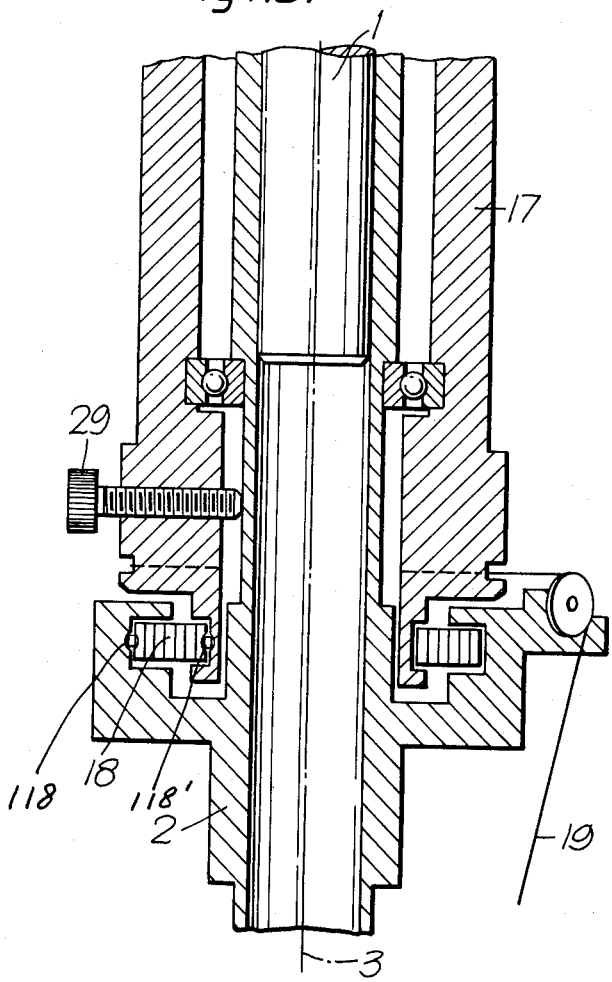
Fig. 6.
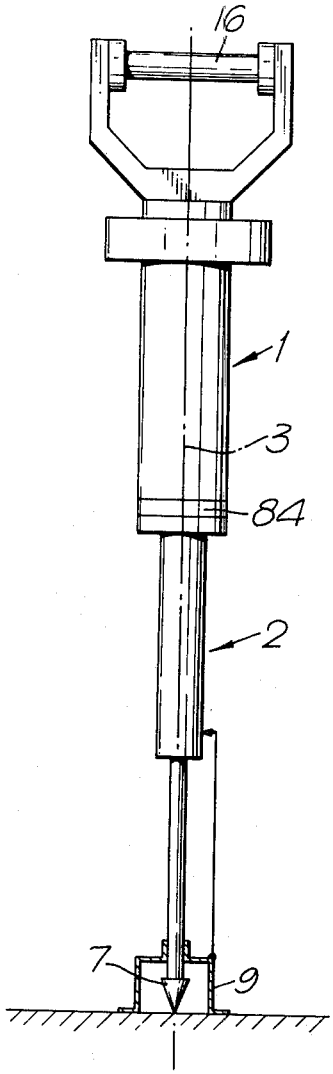
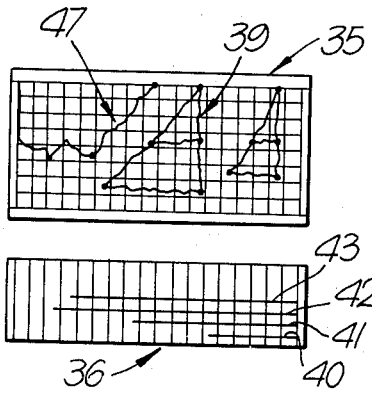
Fig. 5.
Fig. 7.
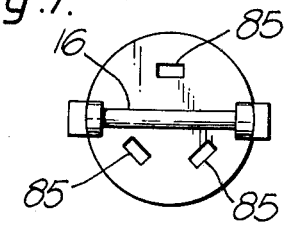

APPARATUS FOR MEASURING THE MECHANICAL CHARACTERISTICS OF A BODY

BACKGROUND OF THE INVENTION

1. Field of the Invention

The present invention relates to an apparatus measuring the mechanical characteristics of a body or medium, particularly the mechanical characteristics of the soil, enabling the following properties of the body or medium analysed to be measured and also, if desired, recorded: resistance to compression when subjected to a force, linear deformation resulting from the said force and also shear, cut or friction strength under the effect of a torque combined with a force exerted along an axis substantially perpendicular to the lever arm of the said torque and intersecting the latter approximately half way along it.

2. Discussion of the Prior Art

Many apparatuses of this kind have already been devised which are of weight and over-all size such that it can be transported by a man.

They may be classified in two categories depending upon their function:

penetrometers for measuring the resistance of the soil or any other medium to the penetration of a probe as a function of the depth of penetration of said probe (U.S. Pat. Nos. 2,130,751 and 3,712,121; German Pat. No. 1,216,574 and British Pat. No. 187,159; Bulletin CNEEMA B1 No. 237 October 1977 47–50; J. agric. Engng Res. (1977), 22, 209–212);

torsiometers able to measure the resistance of the soil or many other coherent medium to a shear and/or friction torque as a function of the compressive force having a direction perpendicular to the plane of the torque and to the plane of shearing and/or of friction (U.S. Pat. Nos. 3,116,633 and 3,797,301; Engineering Vol 199, No. 5159, Mar. 5, 1965) "Soil Shearing Meter" p. 315).

These measures are obtained via a digital meter or, for more sophisticated versions via a recording device requiring mostly very complicated appliance.

There is presently no lightweight device which may be used and carried by a single operator and which allows a combination of the both functions of the above measures i.e. penetrometric and torsiometric measures.

Only very heavy equipments are available for performing both penetrometric and torsiometric measures which depend on electro-hydraulic and/or pneumatic appliances (such as the BEVAMETER) and thus make necessary the use of teams of specialized operators and specific motor vehicles.

OBJECTS OF THE INVENTION

Accordingly, it is an object of the invention to provide a lightweight apparatus which may be used in situ by a single operator and which may perform the measures of the both following functions:

resistance to compression and resulting linear deformation;

resistance to a torque and axial compressive force.

It is a further object of the invention to provide an exclusively mechanical device where both measures are performed by a simple, reliable and precise mechanical appliance.

It is a further object of the invention to provide an apparatus permetting the recording of the measures in Cartesian coordinates.

SUMMARY OF THE INVENTION

The apparatus of the present invention comprises two elements aligned in accordance with their axis, first means provided between the said two elements and arranged to combine them and to oppose the relative displacements of said elements along their axis, when a stress along the said axis is applied at the free end of one of these elements and directed towards the other element, and also to oppose the rotation of the elements in relation to each other around their axis, a probe affixed to the free end of one of the elements, second means provided at the free end of the other element to enable the aforementioned stress to be applied in accordance with the axis of the elements and a torque to be applied to the elements in relation to their axis, a cursor arranged to move along the element bearing the probe, parallel to the axis of the said element, from the free end of the probe towards the other element, when the probe penetrates into the body or medium to be measured and third means arranged, in a first position, to enable the aforementioned stress along the axis of the element bearing the probe and the displacement of the cursor on the element bearing the probe to be measured simultaneously and, in a second position, for the simultaneous measurement of the said stress along the axis of the elements and the aforementioned torque, the conversion from the said first position to said second position being obtained by a locking appliance able to solidarize the said third means to the element bearing the probe.

In one particularly advantageous embodiment of the invention the said third means which the apparatus comprises for the measurement of the stress, the displacements and the torque are supplemented by means enabling these three magnitudes to be recorded.

The invention also relates to a device for calibrating the said apparatus, as well as probes designed to be used in conjunction with this latter.

BRIEF DESCRIPTION OF THE DRAWINGS

FIG. 1A is an elevation, partly broken away, of the apparatus of the invention.

FIG. 1B is a part-view of a detail of FIG. 1A, illustrating the connection between the three main parts of the apparatus.

FIG. 2 is a part-view along the line II—II of FIG. 1, of a detail of the apparatus shown in FIG. 1.

FIG. 3 is a developed view of a measurement recording operation carried out on the apparatus shown in FIGS. 1 and 2.

FIG. 4 is a view analogous to FIG. 1 and partly broken away, illustrating a variant of the apparatus shown in FIGS. 1 and 2.

FIG. 5 is a developed view of the measurement recording operations performed on the apparatus illustrated in FIG. 4.

FIG. 6 is an elevation of a variant of the apparatus shown in FIGS. 1, 2 and 4.

FIG. 7 is an plan view corresponding to FIG. 6.

Identical or analogous components retain the same reference numbers throughout the different figures.

DETAILED DESCRIPTION OF THE DRAWINGS

Figure 8:
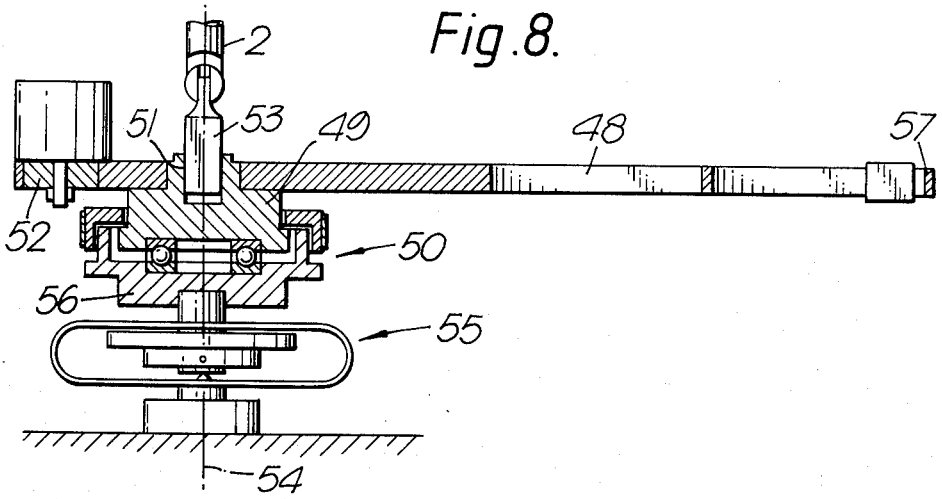
FIG. 8 is an elevation, partly broken away, of the device designed to enable the aforementioned apparatus to be calibrated.
Figure 9:
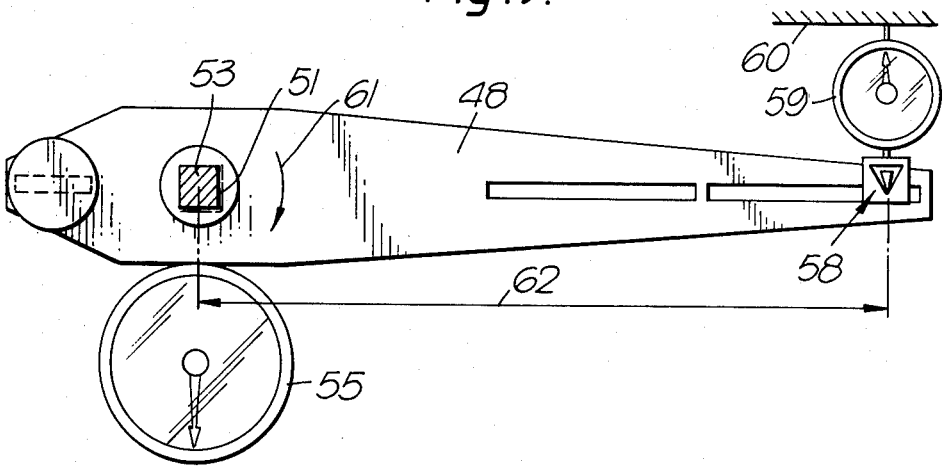
FIG. 9 is a schematic plan view corresponding to FIG. 8.

The apparatus covered by the invention and shown in FIGS. 1 and 2 comprises two coaxial tubular elements 1 and 2 mounted on the telescopic principle so that they can undergo displacement in respect of each other along their common axis 3 and rotate in respect of each other about the said axis, first means 4 being provided between the elements 1 and 2 and arranged in such a way as to oppose the displacements of the elements 1 and 2 in respect of each other along their axis 3 when the distance between the free opposite ends 5 and 6 of the said elements decreases and oppose the rotation of the elements in respect of each other about their common axis 3, a probe 7 affixed to the free end 6 of the element 2, second means 8 provided at the free end 5 of the element 1 to enable a stress to be exerted in accordance with the axis 3 of the elements, in order to reduce the aforementioned distance and cause them to rotate in respect of each other about their axis 3, a cursor 9 arranged to move along the element 2 parallel to the axis of the latter, from the free end 10 of the probe 7 towards the element 1, when the aforementioned distance decreases, third means 11 arranged to measure the displacement of one element in respect of the other along their common axis 3 and measure the displacement of the cursor 9 on the element 2, these third means 11 being also arranged to measure the displacement of one element in respect of the other in accordance with their axis and the rotation of the elements in respect of each other. Fourth means 12, are advantageously combined with the third means 11, and enable the measurements of the aforementioned displacements and rotation of the elements 1 and 2 in respect of each other and the displacements of the cursor 9 to be recorded. The first means 4, positioned between the elements 1 and 2 in order to oppose their displacement along their common axis and their rotation about this latter, consist of a helicoidal spring 13, which is scaled or calibrated and which is coaxial with the elements. This spring is mounted between the said elements in such a way as to be compressed when the aforementioned distance decreases, the end 14 of the spring being affixed to the element 1 while the other end 15 of the spring is affixed to the element 2. The second means 8 enabling the aforementioned stress and torque to be applied, consist of two handles 16, as shown in FIG. 3, articulated like the handles of a shooting stick and mounted at the end 5 of the element 1 in such a way that they are symmetrical in respect of a plane passing through the axis 3 of the elements, a spherical level 117 being advantageously situated between the two handles 16 to enable the axis 3 of the elements 1 and 2 to coincide with the vertical. The third means 11, arranged to measure the displacements of the elements 1 and 2 and of the cursor 9 along the axis 3 as well as the rotation of these elements in respect of each other, comprise of cylinder 17 of which the axis coincides with the axis 3 of the elements and which is mounted on the element 2, to the opposite of the probe 7, via ballbearings 30, so that it can rotate freely about the axis 3 and about the element 2 and be axially integrated with the said element, a spiral spring 18 mounted between the cylinder 17 and the element 2, one end of the spring 18 being affixed to the cylinder 17 while its other end is affixed to the element 2, (the way in which the ends 118 and 118' are thus secured is visible on FIG. 1A), a cable 19 of which the end 20 is affixed to the cursor and of which the other end 21 is affixed to the cylinder 17, this latter having a peripheral groove 22 in which the cable 19, biased by the spiral spring 18 can be wound up when the cursor 9 is moving, on the element 2, from the probe towards the cylinder 17, the spring 18 and the cursor 9 being equilibrated in such a way that the rotation of the cylinder 17 about its axis 3 is connected with the displacement of the cursor 9 along the element 2, pulleys 23 and 24 being provided on the element 2 for the purpose of guiding the cable 19, the pulley 24 being mounted on a triaxial support enabling its position to be regulated in all directions. On its periphery the cylinder 17 is provided with means for affixing a sheet of graph paper 25 (see FIG. 3) with graduations 26 distributed according to generatrices of the cylinder and graduations 27 perpendicular to the graduations 26, a stylet 28, serving to record the measurements on the sheet 25, being affixed to the element 1, a pressure screw 29 also being provided in order to immobilize the cylinder 17 in respect of the element 2.

The apparatus according to the invention, when used for measuring the resistance of the aforementioned body or medium to compression under the effects of a force or the linear deformation of the said body or medium under the effect of the same force, functions as follows: by means of the level 17 the axis 3 is caused to coincide with the vertical, the handles 16 are subjected to a force in accordance with the axis 3 and directed towards the body to be measured, thereby causing the element 1 to slide on the element 2, in opposition to the spring 13, in such a way that the distance between the ends 5 and 6 of the elements 1 and 2 is reduced. The cylinder 17 being free to rotate about the axis 3 and the element 2, and the probe 7 entering the body or medium under the effect of the pressure exerted on the handles 16, the said cylinder is caused to rotate about the axis 3 by the spiral spring 18, since the cursor 9, resting on the said body or said medium, moves on the element 2, in the direction of the cylinder 17, by the same distance as that by which the probe penetrates the body or medium. The spiral spring 18 and the cursor 9 being equilibrated, the cylinder 17, connected to the cursor 9 by the cable 19, will interrupt its rotatory movement as soon as the cursor 9 is immobilized. The stylet 28, affixed to the element 1 and moving along a rectilinear traject, will trace on the sheet 25, wound on to the cylinder 17 during the rotation of the latter, a diagram 31 which indicates the depth of penetration of the probe 7 according to the arc (1-4) and the compressive force exerted on the handles 16 according to the generatrix (4-3), the area of the figure (1,2,3,4) being the measure of the mechanical work of the insertion of the probe into the body or medium. This diagram 31 thus mainly expresses the continuous variation of the compressive force exerted on the handles 16 and the resistance of the body as a function of the depth of penetration of the probe 7, this variation reflecting, in particular the heterogeneity of the body undergoing the test.

When the apparatus is used for testing the resistance of a body to shearing, cutting or friction under the effect of a torque combined with a pressure exerted on the body in accordance with the axis 3, the cylinder 17 is locked on the element 2 by the pressure screw 29, so that any rotation of the cylinder 17 about the axis 3 is rendered impossible, the spring 18 and the cursor 9 no longer exerting any effect on the said cylinder 17. The diagram 32 traced on the sheet 25 by the stylet 28 and indicating the compressive force exerted on the handles 16 in accordance with generatrix (1,2,4,6) and the moment of the couple according to the arc (2,3–4,5–6,7) will make it possible to deduce the resistance to shearing or cutting or the angle of friction under the effect of a given compressive force.

One of the advantages of the apparatus according to the invention resides in the fact that the aforementioned two tests, with the cylinder 17 rotating freely on the element 2 and with the cylinder 17 blocked on the element 2, can be carried out in succession to each other at one and the same place on the body being tested.

Needless to say, the apparatus according to the invention could be provided with a cylinder 17 itself marked with the graduations 26 and 27, the stylet 28 then being replaced by an index enabling a direct reading of the measurements to be taken.

The apparatus according to the invention and illustrated in FIG. 4 is identical, as regards the elements 1 and 2, to that described above and is provided with recording means 12 arranged to enable the compressive force exerted on the handles 16, the depth of penetration of the probes 7 and the torque exerted on the said handles to be recorded simultaneously. These means 12 comprise two cylinders 33 and 34, independent of each other and with equal external diameters and with axes coinciding with the axis 3 of the elements 1 and 2, these cylinders being mounted so as to form prolongations of each other, outside the element 2 and opposite the probe 7, in such a way that they can rotate freely, thanks to the ballbearings, about their axis and about the said element 2, and so that they can be immobilized in relation to the axis 3 in this element. These means 12 also comprise a spiral spring 18 mounted between the cylinder 34 and the element 2, one end of the spring being affixed to the said cylinder 34 while its other end is affixed to the element 2, a cable 19 of which one end is affixed to the aforementioned cursor 9 and of which the other end is affixed to the cylinder 34, this cylinder having a peripheral groove 22 and in which the cable 19, biased by the spiral spring 18, can wind up when the cursor moves on the element 2 from the probe 7 towards the cylinder 34, the spring 18 and the cursor 9 being equilibrated in such a way that the rotation of the cylinder 34 about its axis is connected with the displacement of the cursor 9 along the element 2, pulleys 23 and 24, such as described farther back, being provided on the element 2 for the purpose of guiding the cable 19. The two cylinders 33 and 34 are provided on their periphery with means for affixing a sheet of graph paper 35, 36, the first graduations 26 being provided on the sheet 35 and distributed according to generatrices of the cylinders and the second graduations 27 being provided perpendicularly to the first, a stylus 37, adjustable in position, being provided to interact with the sheet 36 of the cylinder 34 and affixed to the element 2, while a stylet 28 is provided to interact with the sheet 35 and the cylinder 33 and affixed to the element 1, a pressure screw 38 also being provided for the purpose of immobilizing the cylinders 33 and 34 in respect of each other, as well as a pressure screw 39 serving to immobilize the cylinder 33 in respect of the element 2.

For the combined recording of the aforementioned three measurements the cylinder 33 is first of all immobilized on the element 2, by the aid of the screw 39, so that the cylinder can no longer rotate about the element, and the pressure screw 38 is released, so that the cylinder 34 is free in respect of the cylinder 33 and can be caused to rotate about the element 32 by the spiral spring 18 when the cursor 9 is moving along the element 2, when the probe 7 inserts itself into the body being tested. The stylus 28, when a pressure is exerted in accordance with the axis 3 and directed towards the probe 7, and torsion is also exerted around the axis 3, in opposition to the spring 13, will record on the sheet 35 this dual deformation of the spring 13, i.e. its compression and its torsion, in accordance with the diagram 39, analogous to the diagram 32 already described farther back, while the stylus 37 will record on the sheet 36, as result of the displacement of the cursor 9 and the rotation of the cylinder 34 about the element 2 under the action of the spiral spring 18, the depth to which the probe 7 penetrates the body. It will be seen that the sheet 36 has four segments 40, 41, 42 and 43, showing those depths of penetration of the probe 7 which are recorded in the course of four successive tests, the stylus 37 being displaced parallel to the axis 3, in each test, causing the bar 44, bearing the said stylet, to slide in such a way as to engage the stop 45, notch by notch, in the successive stops 46 of the said bar. After these operations the cylinder 33 will be released from the element 2 by loosening the pressure screw 39, and the said cylinder 33 will be immobilized in respect of the cylinder 34 by tightening up the pressure screw 33. The cylinders 33 and 34 can then be caused to rotate about the element 2 by the spiral spring 18 when the cursor 9 moves on the element 2, when the probe 7 inserts itself in the body. The stylet 28 will then trace on the sheet 35 the diagram 47 indicating the mechanical work corresponding to the insertion of the probe and analogous to the diagram 31 described farther back, and the segment which will be recorded on the sheet 36 by the stylus 37 during the rotation of the cylinder 34 will give a superfluous reading, i.e. it will duplicate the indication supplied by the diagram 47 in respect of the depth of penetration of the probe 7. This variant of the apparatus shown in FIG. 4, is of particular advantage for the recording of combined compressive and torsional measurements at given depths.

Like the apparatus shown in FIG. 1, that shown in FIG. 4 could be provided with cylinders 33 and 34 bearing the aforementioned graduations direct, the stylets 28 and 37 then being replaced by indices enabling a direct reading of the measurements to be taken.

The calibration of the apparatus shown in FIGS. 1, 2 and 4 on the basis of the simple compression of the spring 13 can be effected direct on the pan of a balance, each scale point being identified on the graph paper 25 of 35, according to a generatrix of the cylinder 17 or 33, by a "torsion jump" assigned by the aid of the handles 16.

On the other hand, the calibration of this apparatus on the basis of the combined torsion and compression of the spring 13 necessitates the use of the calibration device according to the invention, illustrated in FIGS. 8 and 9. This calibration device comprises a lever 48 affixed to one of the cages 49 of a thrust ball bearing 50, a housing 51 near the end 52 of a lever being provided in this cage and serving to accommodate a piece 53, of dimensions corresponding to those of the housing 51 and mounted on the apparatus in order to replace the probe 7, the axis 54 of the housing being vertical and coinciding with the axis of the element 2 and the axis of the thrust ball bearing 50, this latter serving, when the torque is applied to the apparatus to be calibrated, to minimize the frictional resistance produced by the compressive force exerted on the apparatus according to the axis of the elements 1 and 2 and directed towards the calibration device. This calibration device also comprise a ring dynamometer 55, aligned with the axis 54 and affixed to the cage 56 of the thrust ball bearing 50 and enabling the aforementioned compression to be measured. The device also includes, near the end 57 of the lever 48, means 58 enabling the said lever to be associated with a dynamoneter 59, fixed at the point marked 60 and arranged to be subjected to tension when the lever 48 is caused to rotate about the axis 54 and in the direction shown by the arrow 61, when the aforementioned torsion is exerted on the apparatus to be calibrated, the moment of the torque being determined by the product of the force indicated by the dynamoneter 59 by the lever arms 62. These calibration operations will be carried out, according to the particular type of apparatus adopted, either with the cylinder 17 locked on the element 2 by the aid of the pressure screw 29 (FIG. 1) or with the cylinder 33 locked on the element 2 by the aid of the pressure screw 39 (FIG. 4), and the indication of each calibration point, whether in respect of the loading or of the unloading, will be added to the graph sheet 25 or the sheet 35, care being taken to define the "tares" and the "drifts" from the "zero" points on the recording scales.

In addition to the mechanical apparatus described above, with its spring 36, the invention also convers an apparatus having an electronic measuring system designed to pick up and measure, simultaneously and independently, with an analog or digital recording system, a stress undergone and the displacement of the cursor 9 in accordance with the axis 3 and a torsion couple occurring about this axis. This system, which is provided on the apparatus shown schematically in FIGS. 6 and 7, comprises a pick-up 84, which is known per se (such as the 2-component load washer ($F_z$,$M_z$) of KISTLER Instrumente) and which is either rigid or deformable and which is aligned in respect of the elements 1 and 2, constituting the apparatus, this pick-up being positioned between these two elements and affixed to each of these latter, the said system likewise comprising an electronic circuit connected to the pick-up 84 and to the cursor 9, provided with an amplifier, accommodate in the element 1, and designed to amplify the signals emitted, on the one hand, by the pick-up 84, when the stress is exerted on the handles 16 (pressure according to the axis 3 and/or torsion exerted about this axis), and on the other hand by the cursor 9, in the course of its movements over the element 2, this electronic circuit having three digital display dials 85 indicating the value of the stress according to the axis 3, of the torque exerted about this axis and of the traject covered by the cursor 9.

Figure 10:
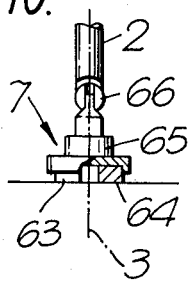
FIG. 10 is an elevation, partly broken away, of a probe intended for use in conjunction with the aforementioned apparatus.

That end of the element 2 to which the probe 7 is affixed is designed to enable various types of probe to be mounted thereon without loss of time, according to the particular tests carried out. The probe 7 according to the invention and shown in FIG. 10 is intended for testing the friction or the adherence of a support and consists of an annular body 63 having a flat base 64 designed to rest on the aforementioned support, immobilized in a central holding sleeve 65 arranged in such a way that the axis of the annular body coincides with the axis 3 of the elements 1 and 2 of the apparatus, a universel joint 66 being provided on the central holding sleeve in order to reduce the effects of the lack of perpendicularity and parallelism between the surfaces in contact, i.e. the flat base 64 and the support, and thus reduce the measuring errors which may arise from these defects. In order to test the carrying power of a deformable support a cylindrical body will be used instead of a probe provided with the annular body 63.

Figure 11:
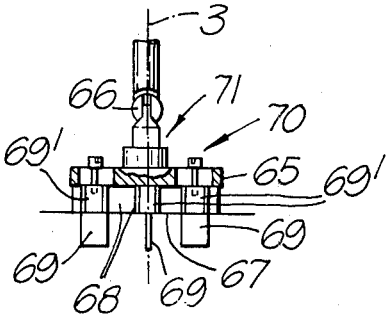
FIG. 11 is an analogous view to FIG. 10.

The probe 7 according to the invention and shown in FIG. 11 is intended as a means of evaluating resistance to shear or cutting. This probe comprises a central holding sleeve 65 having a flat circular base 67 designed to rest on the ground, four radial cuts 68 evenly distributed and provided in the central holding sleeve, starting from the base 67, movable blades 69 identical to one another, of which each one is designed to be secured in one of the cuts 68, in order to project in relation to the said base 67, these blades each having a prolongation 69' designed to penetrate the corresponding cuts and representing a regular polygon in cross section, such as a square, or else a circle, so that by rotating the prolongation it is possible to regulate the position of the blades, in order to arrange them radially in respect of a base 67 or transversally in respect of the radii of this latter, means 70 for securing the prolongations 69' in the cuts 68, these means being so arranged that the said prolongations can be displaced and fixed over an ample portion of the length of cuts. The means 71 for assembling the central holding sleeve with the element 2 are arranged in such a way that the axis 3 of the elements 1 and 2 will pass through the centre of the base 67, these means 71 comprising universal joints 66, in order to reduce the effects of the lack of perpendicularity and parallelism mentioned farther back. The blades 69 are interchangeable, and the profile of that part of the blades which is intended to project in relation to the surface 67 will be selected in accordance with the capacity of the apparatus and with the couple which the user will be able to exert on the apparatus. The method of securing the blades 69 by means of the prolongations 69' enables them to be "staggered" in relation to their mounting axis, thus enabling the probe to function as a chisel.

Figure 12:
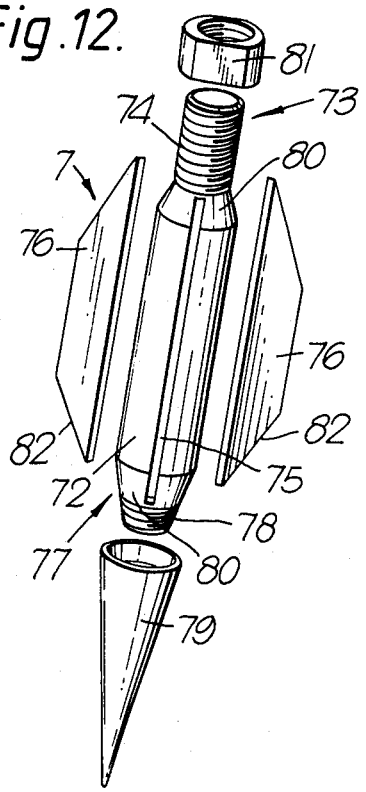
FIG. 12 is an exploded view, in perspective, showing the various elements of a probe in accordance with the invention.
Figure 13:
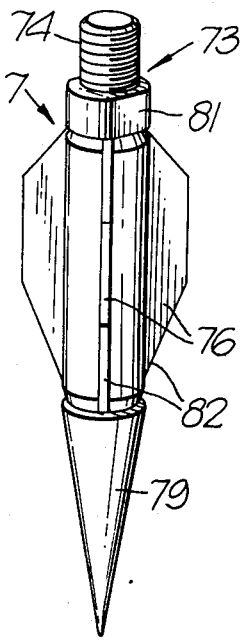
FIG. 13 is a view of the probe shown in FIG. 12, its elements being illustrated in the assembled position.

The probe 7 according to the invention and shown in FIGS. 12 and 13 is designed for the combined measurement of compressive and shearing resistances and is a particularly suitable means of making the fullest use of the characteristics of the apparatus described farther back. This probe comprises a cylinder 72 of which the end 73 has a screw threading 74 to enable the probe to be affixed to the element 2. This cylinder 72 is provided with grooves 75 which are regularly spaced out over its periphery and which follow the generatrices of the cylinder and of which each one is intended to accommodate a movable blade 76, the cylinder also being provided, as its other end 77, with a screw threading 78 as a means of affixing a cone 79 of which the axis coincides with that of the cylinder and of which the base is substantially equal to the bases of the cylinder. The cylinder is provided at its two ends with truncated cones 80 in which the grooves 75 are prolonged. The blades 76 extend, in the grooves 75, over the entire length of these latter, being profiled, in their zones to the right of the truncated cones 80, in such a way that they are flush with the lateral surface of the said truncated cones 80 when completely engaged in the grooves 75, while the cone 79 and a tightening nut 81, interacting with the screw threadings 78 and 74, are arranged internally in such a way as to come to rest against the truncated cones 80 and block the blades 76 in their grooves, as shown in FIG. 13. In order to prevent the penetration of the blades into the ground from influencing the resistance offered by the cone 79 during the operation of measuring the penetration force, the zones 82 of the said blades are sharpened. Needless to say, different types of cone and blade can be fitted to the cylinder 72, according to the particular tests to be performed.

Figure 14:
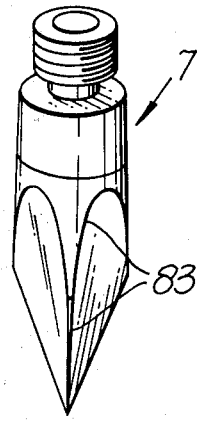
FIG. 14 is a view in perspective showing a variant of the probe illustrated in FIGS. 12 and 13.

The probe shown in FIG. 14 is a simplified variant of the probe with blades shown in FIGS. 12 and 13 and is intended for the same purpose as this latter probe. In the testing of soil, however, this simplified probe can only be used in sand or light mud, owing to the fact that the shearing caused by the edges 83 takes place in a zone of the soil which has been compressed and driven during the insertion of the probe.

Figure 15:
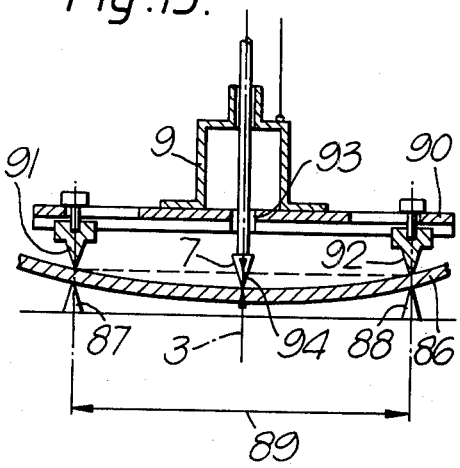
FIG. 15 is a schematic diagram, in elevation and partly broken away, showing a particular way of using the apparatus to which the invention relates.

The apparatus according to the invention will normally be used in such a way that its axis 3 coincides with the vertical, the probe 7 being directed downwards. The said apparatus may also be used in some other position, e.g. in an oblique position in relation to the vertical, in a horizontal position, in an oblique position in relation to the horizontal or else with the probe 7 directed upwards and the apparatus positioned with a vertical axis or obliquely in respect of the latter. In the calibration of the apparatus, needless to say, it will be desirable to take account of the position in which it is to be employed. The apparatus according to the invention also makes it possible, as shown in FIG. 15, to measure the flexural resistance of a light structure 86. To carry out this measurement the structure 86 is placed on two knives 87 and 88 situated a certain distance 89 apart. A rigid rod 90 fitted with two knives 91 and 92 are then placed on the structure 86, the distance between the latter two knives having been selected so that it corresponds to the distance 89 and these knives will be situated opposite the knives 87 and 88, the said rod 90 having an opening 93 intended to give passage to the probe 7 of the apparatus, the said probe being exactly half way between the knives 87 and 88. When the probe 7 is introduced into this opening 93 the cursor 9 of the apparatus comes to rest against the rod 90, and when a pressure is exerted on the apparatus, in accordance with the axis 3 and directed towards the structure 86, this structure is caused to sag, the recording device of the apparatus described above then enabling the value of the pressure exerted on the apparatus and thus on the structure 86, as well as the value of the deformation deflection 94 undergone by the said structure, to be recorded in a system of coordinates.

Among numerous uses in which the recording of the measurements will enable a continuous and permanent diagram to be obtained of the measurements taken, whether under stable or temporary conditions, thus giving a synthetic and reliable view of the phenomena studied, it should be borne in mind that the apparatus according to the invention makes it possible, in particular, to determine the mechanical properties of soils occurring in agricultural and forestry, in order to define the critera for utilization of the soil, ploughing operations, irrigations projects, drainage work and anti-erosion measures; specification and delimitation of pedological or physical profiles, the evaluation of stabilized and temporary characteristics of soils, for the purpose of earth works, various movements, for the forecasting of certain requirements arising on working sites, such as time, power and energy, the evaluation of the resistance and bearing capacity of the ground for locomotion, the planning and exercise of various activities, the evaluation of traction performances over routes liable to undergo deformation (bearing capacity, shear) for tractors, tired vehicles and caterpiller tract vehicles, the evaluation of the surface adhesion of a coating, a track, materials, adhesion which in connection with locomotion, handling or construction governs the performances, stability, safety and comfort obtainable, the study of the incidence of factors liable to affect the mechanical qualities of the soil, hard tracks materials and substances; humidity, temperature, weather conditions and climate, treatment products, actions of all kinds, the analysis of the behaviour and performances of new vehicles, improvements in tools (shape and dimensions), methods of treatment, the study of the characteristics of hard, plastic, granular or fibrous material: homogenity, plasticity, cohesion, firmness of pressure, internal friction, natural slope, resistance to shear, cutting, grinding, mixing, chopping, crushing.

What I claim is:

1. An apparatus for measuring mechanical characteristics of a body or medium, such as soil, comprising two elements aligned in accordance with their common axis; first means provided between said two elements and arranged to combine them and to oppose the relative displacements of said elements along their common axis, when a stress along the said axis is applied at the free end of one of these elements and directed towards the other element; and also to oppose the rotation of the elements in relation to each other around their axis, a probe affixed to the free end of one of the elements; second means provided at the free end of the other element to enable the aforementioned stress to be applied in accordance with the axis of the elements and a torque to be applied to the elements in relation to their axis; a cursor arranged to move along the element bearing the probe, parallel to the axis of the said element, from the free end of the probe towards the other element, when the probe penetrates into the body or medium to be measured; and third means arranged, in a first position, to enable the aforementioned stress along the axis of the element bearing the probe and the displacement of the cursor on the element bearing the probe to be measured simultaneously and, in a second position, for the simultaneous measurement of said stress along the axis of the elements and the aforementioned torque, the conversion from the said first position to said second position being obtained by a locking appliance able to solidarize said third means to the element bearing the probe.

2. An apparatus in accordance with claim 1, wherein the said first means provided between the said two elements comprises an electronic pick-up appliance, aligned in respect of said two elements and affixed thereto, which is responsive to compression-stress and to a torque occuring about the common axis of said two elements.

3. An apparatus in accordance with claim 2 comprising an electronic measuring circuit connected to the pick-up and to the cursor, provided with an amplifier to amplify the signals emitted by the pick-up and by the cursor in the course of its movements over the said first element, this electronic circuit having three digital display dials indicating the value of the stress according to the axis of the torque exerted about this axis and the trajectory covered by the cursor.

4. An apparatus in accordance with claim 1, wherein said two elements are two tubular elements mounted on the telescopic principle allowing displacement in respect of each other along their common axis and rotation in respect of each other about said axis, wherein said first means is provided between said two elements and is arranged in such a way as to oppose the displacements of said elements in respect of each other along their axis when the distance between the free opposite ends of said elements decreases and oppose the rotation of said elements in respect of each other about their common axis, wherein a probe is affixed to the free end of the first element, wherein said second means is provided at the free end of the second element to enable a stress to be exerted in accordance with the common axis of said two elements, in order to reduce the aforementioned distance and cause them to rotate in respect of each other about their common axis, wherein a cursor is arranged to move along the first element parallel to the axis of the latter, from the free end of the probe towards the second element, when the aforementioned distance decreases, and wherein said third means is arranged to measure the displacement of one element in respect of the other along their common axis and measure the displacement of the cursor on the element, said third means being also arranged to measure the displacement of one element in respect of the other in accordance with their axis and the rotation of the elements in respect of each other.

5. An apparatus in accordance with claim 4, wherein said first means positioned between the elements in order to oppose their displacement along their common axis and their rotation about this latter, consists of a helicoidal scaled spring, which is coaxially with the said two elements and mounted between said two elements in such a way as to be compressed when said distance decreases, one of the ends of the spring being affixed to the first element while the other end of the spring is affixed to the second element.

6. An apparatus in accordance with claim 1, wherein said third means is supplemented by fourth means for recording the measurements of the displacements and rotation of said two elements in respect of each other and the displacements of the cursor.

7. An apparatus in accordance with claim 1, wherein said second means enabling the aforementioned stress and torque to be applied, consists of two handles which are affixed at the free end of said second element.

8. An apparatus as in any one of claims 4–7 wherein said third means arranged to measure the displacements of the elements and of the cursor along the common axis of the two elements as well as the rotation of these elements in respect of each other, comprises a cylinder of which the axis coincides with the common axis of said two elements and which is mounted on the said first element, opposite to the probe, via ballbearings so that it can rotate freely about said common axis and about said first element and be axially integrated with said cylinder and said first element, one end of said spring being affixed to said cylinder while its other end is affixed to said first element, a cable of which one end is affixed to the cursor and of which the other end is affixed to said cylinder which has a peripheral groove in which the cable biased by a spiral spring can be wound up when the cursor is moving, on the first element, from the probe towards the cylinder, the spring and the cursor being equilibrated in such a way that the rotation of the cylinder about its axis is dependent on the displacement of the cursor along the first element, and fifth means being provided on the first element for guiding the cable.

9. An apparatus in accordance with claim 8, wherein said cylinder is provided on its periphery with means for affixing a sheet of graph paper with first graduations distributed according to generatrices of said cylinder and second graduations perpendicular to the first graduations, a stylet serving to record the measurements on the sheet being affixed to the second element, a pressure screw also being provided in order to immobilize said cylinder in respect of the first element.

10. An apparatus as in any one of claims 4–7, wherein said third means comprises two cylinders, independent of each other and with equal external diameters and with axes coinciding with the common axis of said two elements, these cylinders being mounted so as to form prolongations of each other, outside the first element and opposite the probe, in such a way that they can rotate freely, about their axis and about said first element, and so that they can be immobilized in relation to the axis in this element, a spiral spring mounted between the first cylinder and the first element, one end of the spring being affixed to said first cylinder while its other end is affixed to said first element, a cable of which one end is affixed to the cursor and of which the other end is affixed to said first cylinder, this cylinder having a peripheral groove and in which the cable, biased by the spiral spring, can wind up when the cursor moves on the first element from the probe towards the first cylinder, the spring and the cursor being equilibrated in such a way that the rotation of the first cylinder about its axis is connected with the displacement of the cursor along the first element, pulleys being provided on the first element for the purpose of guiding the cable.

11. An apparatus according to claim 10, wherein said two cylinders are provided on their periphery with means for affixing respective sheets of graph paper, first graduations being provided on the sheet and distributed according to generatrices of the cylinders and second graduations being provided perpendicularly to the first one, a stylet adjustable in position, being provided to interact with the first sheet of the first cylinder and affixed to the first element, while a stylet is provided to interact with the second sheet of the second cylinder and affixed to the second element, a pressure screw also being provided for the purpose of immobilizing the cylinders in respect of each other, as well as a pressure screw serving to immobilize the second cylinder in respect of the first element.

12. An apparatus as in any one of the claims 4–7 equippped with a calibration device comprising a lever which is affixed to one of the cages of a thrust ball bearing, a housing near the end of a lever being provided in this cage and serving to accommodate a piece of dimensions corresponding to those of the housing and mounted on the apparatus in order to replace the probe, the axis of the housing being vertical and coinciding with the axis of the element and the axis of the thrust ball bearing, a ring dynamometer, aligned with the axis and affixed to the cage of the thrust ball bearing and near the opposite end of the lever, means enabling said lever to be associated with a dynamometer, and arranged to be subjected to tension when the lever is caused to rotate about the vertical axis.

13. An apparatus as in any of the claims 1–7, wherein the probe comprises a cylinder of which the one end has a screw threading to enable the probe to be affixed to the first element, this cylinder being provided with grooves which are regularly spaced out over its periphery and which follow the generatrices of the cylinder and of which each one is intended to accommodate a movable blade, the cylinder also being provided, at its other end, with a screw threading as a means of affixing a cone of which the axis coincides with that of the cylinder and of which the base is substantially equal to the bases of the cylinder, the cylinder being further provided at its two ends with truncated cones in which the grooves are prolonged, while the cone and a tightening nut, interacting with screw threadings, are arranged internally in such a way as to come to rest against the truncated cones and block the blades in their grooves.

14. An apparatus in accordance with claim 1, wherein a spherical level is associated with said second means.

15. An apparatus as in any of the claims 1–7, wherein the probe comprises a central holding sleeve having a flat circular base designed to rest on the ground, several radial cuts evenly distributed and provided in the central holding sleeve, starting from the base, movable blades identical to one another, of which each one is designed to be secured in one of the cuts, in order to project in relation to the said base, these blades each having a prolongation designed to penetrate the corresponding cuts and representing a regular polygon in cross section, so that the rotation of the prolongation regulates the position of the blades, in order to arrange them radially in respect of a base or transversally in respect of the radii of this latter, means for securing the prolongations in the cuts, these means being so arranged that said prolongations can be displaced and fixed over an ample portion of the length of cuts, and means for assembling the central holding sleeve with the first element arranged in such a way that the common axis of the two elements will pass through the center of the base.

* * * * *